US011242705B2

(12) United States Patent
Salutzki et al.

(10) Patent No.: US 11,242,705 B2
(45) Date of Patent: Feb. 8, 2022

(54) DOOR ACTUATOR

(71) Applicant: dormakaba Deutschland GmbH, Ennepetal (DE)

(72) Inventors: Thomas Salutzki, Ennepetal (DE); Sabiene Wiemann, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 162 days.

(21) Appl. No.: 16/715,404

(22) Filed: Dec. 16, 2019

(65) Prior Publication Data

US 2020/0224478 A1 Jul. 16, 2020

(30) Foreign Application Priority Data

Jan. 16, 2019 (EP) ..... 19152193

(51) Int. Cl.
*E05F 1/10* (2006.01)
*E05F 3/10* (2006.01)
*E05F 11/54* (2006.01)

(52) U.S. Cl.
CPC ..... *E05F 1/10* (2013.01); *E05F 3/104* (2013.01); *E05F 11/54* (2013.01); *E05Y 2201/638* (2013.01); *E05Y 2201/706* (2013.01); *E05Y 2600/46* (2013.01); *E05Y 2900/132* (2013.01)

(58) Field of Classification Search
CPC . E05F 3/104; E05F 3/227; E05F 3/225; E05F 3/10; E05Y 2201/638; E05Y 2201/706; E05Y 2600/46; E05Y 2900/132; Y10T 16/2769
See application file for complete search history.

(56) References Cited

U.S. PATENT DOCUMENTS 3,474,485 A * 10/1969 Milan ..... E05F 3/104 16/55
3,838,477 A * 10/1974 Evans ..... E05F 3/104 16/55
4,658,468 A * 4/1987 Tillmann ..... E05F 3/104 16/53
5,417,013 A * 5/1995 Tillmann ..... E05F 3/104 16/53
5,802,670 A * 9/1998 Bienek ..... E05F 3/10 16/53
7,966,771 B2 * 6/2011 Bienek ..... E05F 3/104 49/340

(Continued)

*Primary Examiner* — Justin B Rephann
(74) *Attorney, Agent, or Firm* — Cantor Colburn LLP

(57) ABSTRACT

A door actuator for opening and/or closing a door leaf includes a housing, an output shaft rotatably supported in the housing and with a cam disc, wherein the output shaft is formed for transferring torque onto the door leaf. A first element of motion is linearly movably guided in the housing with a first contact surface. A second element of motion is linearly movably guided in the housing with a second contact surface. A distancing arrangement is disposed in the housing. The cam disc is disposed between the two contact surfaces and for rolling on the two contact surfaces. In at least one delimiting range of angles of rotation of the output shaft, the distancing arrangement delimits the minimum distance between the elements of motion, and, in at least one free range of angles of rotation, does not delimit the linear mobility of the two elements of motion in relation to each other.

14 Claims, 11 Drawing Sheets

(56) References Cited

U.S. PATENT DOCUMENTS

| | | | | |
|---|---|---|---|---|
| 8,826,494 | B2 * | 9/2014 | Bienek | E05F 3/104 16/53 |
| 9,045,926 | B2 * | 6/2015 | Salutzki | F16K 31/0693 |
| 2002/0066157 | A1 * | 6/2002 | Chen | E05F 3/104 16/58 |
| 2011/0197391 | A1 * | 8/2011 | Yu | E05F 3/104 16/51 |
| 2012/0233810 | A1 * | 9/2012 | Salutzki | F16K 31/0693 16/52 |
| 2014/0290144 | A1 * | 10/2014 | Hellwig | E05F 3/22 49/506 |

* cited by examiner

DOOR ACTUATOR

CROSS REFERENCE TO RELATED APPLICATIONS

This application is related to, and claims the benefit of, European Patent Application No. 19152193.9, filed on Jan. 16, 2019, the contents of which are hereby incorporated by reference in their entirety.

TECHNICAL FIELD

The disclosure relates to a door actuator for opening and/or closing a door leaf.

For example, door actuators can be formed as door closers, servo door closers or door drives. The door actuator can be disposed above the door leaf or as a floor door closer. Furthermore, it is possible to dispose a door actuator in a hinge of the door. The type of door actuators considered herein, includes a cam disc. The cam disc is located on the output shaft. The output shaft is directly connected to the door leaf or via an arm assembly. Elements of motion are disposed on both sides of the cam disc in the door actuator, for example they are formed as dampening piston and opening piston. The elements of motion are linearly movable within the door actuator. A translation of the rotary movement of the output shaft into the linear movement of the element of motion and vice versa is realized via the cam disc.

SUMMARY

The present disclosure indicates a door actuator for opening and/or closing a door leaf, which has a simple construction, can be operated in a maintenance reduced and wear reduced manner and allows thereby for a reliable opening and/or closing of the door leaf.

The problem is solved by means of the features of the independent claim. Advantageous further configurations of the disclosure are the subject matter of the dependent claims.

Thus, the problem is solved with a door actuator for opening and/or closing a door leaf. The door actuator comprises a housing and an output shaft, which is rotatably supported in the housing and has a cam disc. The cam disc can be an integral component of the output shaft or be placed upon the shaft, for example. The output shaft is formed for transferring the torque onto the door leaf. Furthermore, the output shaft can be directly connected to the door leaf, for example via a polygon, or be connected to an arm assembly. The arm assembly in turn leads to the door leaf.

Furthermore, a first element of motion and a second element of motion are linearly movably guided in the housing. The first element of motion includes a first contact surface. The second element of motion includes a second contact surface. Preferably, the two contact surfaces are respectively formed by means of a roller, which is rotationally movably disposed in the element of motion. The two contact surfaces are disposed for rolling on the cam disc. For this purpose, the cam disc is located between the two elements of motion and thus between the two contact surfaces. In particular, the two contact surfaces roll on two opposite sides of the cam disc on the cam disc.

For example, the door actuator can be formed as a door closer, as a servo door closer or as a door drive. Basically, the two elements of motion in the housing of the door actuator can be moved in a passive way, for example by means of charging with spring force, or in an active way, for example by means of hydraulic pressure. The movement of the elements of motion is translated into a rotary movement of the output shaft via the cam disc. In the opposite direction, for example upon manually opening the door leaf, the force applied to the door leaf is translated into a rotary movement of the output shaft. Via the cam disc, said rotary movement of the output shaft in turn results in a linear movement of the two elements of motion.

When configuring the door actuator as a door closer, the first element of motion is in particular formed as an opening piston. Preferably in this case, said opening piston is spring-loaded with a first spring (closing spring) in such a manner that the first spring presses the first element of motion in the direction of the cam disc. Upon opening the door leaf, the spring is tensioned. The energy stored thereby in the spring can be employed for moving the first element of motion in the direction of the cam disc and thus for closing the door. When configuring the door actuator as a servo door closer, the first spring is likewise provided. However in this case, tensioning the spring is not exclusively realized via manually actuating the door, but an opening of the door leaf is recognized and thereby an actuating mechanism in the door actuator is activated, which in turn develops the entire or partial force for tensioning the spring. Then for closing the door leaf, the first spring can be relaxed in order to move the first element of motion in the direction of the cam disc.

The second element of motion is in particular formed as a dampening piston. In particular, a hydraulic chamber is located in the housing. By moving the dampening piston, the fluid is driven out of the hydraulic chamber through a throttle, whereby dampening of the movement of the dampening piston and thus also dampening of the rotary movement of the output shaft is realized.

Basically, the two elements of motion are linearly movable independently from each other such that basically the distance between the two elements of motion can change. Basically, thereby the two contact surfaces always rest against the cam disc. This is advantageous in that the geometry of the cam disc is relatively freely selectable and that correspondingly the cam disc does not have to have the same diameter between the contact points to the contact surfaces at each position of angle of rotation. However, within the scope of the disclosure is was recognized that there are positions of angles of rotation of the cam disc, respectively of the output shaft, at which a relatively high surface load is in effect onto the contact surface and in particular onto the cam disc. Thus, the cam disc can have a pointed area, for example. Usually, at a position of angle of rotation of 0° (closed door leaf) said pointed area is located at the second contact surface, for example of the dampening piston. At said pointed area, the radius of the cam disc is relatively small such that there is a relatively high surface load of the cam disc.

In order to prevent said surface load at certain positions of angles of rotation, the inventive door actuator comprises a distancing arrangement disposed in the housing. The distancing arrangement is formed to delimit the minimum distance between the elements of motion at least in a delimiting range of angles of rotation. Herein, with delimiting the minimum distance is described that, with said delimitation, the two elements of motion cannot move any closer towards each other. In this case, increasing the distance between the two elements of motion, namely moving the two elements of motion away from each other, is not delimited by the distancing arrangement. In addition to the at least one delimiting range of angles of rotation is defined at least on free range of angles of rotation of the output shaft.

In said at least one free range of angles of rotation, the linear mobility of the two elements of motion is not delimited by the distancing arrangement. In the free range of angles of rotation the two elements of motion can move as far towards each other that the two contact surfaces rest against the cam disc without being delimited by the distancing arrangement. However, in the at least one delimiting range of angles of rotation, the distancing arrangement is formed so that only one of the two contact surfaces rests against the cam disc and the other contact surface is spaced apart from the cam disc. Said distancing of the one contact surface from the cam disc prevents the above describe surface load.

In particular, the distancing arrangement is formed such that in each free range of angles of rotation the two contact surfaces rest against the cam disc. As already described, the two elements of motion, for example formed as the opening piston and dampening piston, can be moved in different ways in the housing. In particular it is intended the two elements of motion be movable with respectively one spring in the direction of the cam disc. In this case, the configuration and arrangement of the springs is selected such that, in the delimiting range of angles of rotation, the first contact surface (of the first element of motion) rests against the cam disc and the second contact surface (of the second element of motion) is spaced apart from the cam disc. In particular for this purpose, the spring force acting upon the first element of motion is larger than the spring force acting upon the second element of motion.

In particular, it is intended the cam disc be formed in a heart-shape. A pointed area of the cam disc and a depressed area of the cam disc located opposite the pointed area characterize said heart shape. The pointed area of the cam disc is in particular located at a position of angle of rotation of 0°. In particular, the position of angle of rotation of 0° describes the closed condition of the door leaf. The depressed area of the heart-shaped cam disc does not have to be exactly opposite the pointed area, however, is approximately located in the area of 180°, starting from a pointed area at 0°. In particular, the centre of the depressed area is located between 120° and 240°. Thus, the position of angle of rotation of 0° of the cam disc, respectively of the output shaft refers to a closed condition of the door leaf. Simultaneously, the pointed area of the heart-shaped cam disc defines the position of angle of rotation of 0°, such that starting from said pointed area corresponding ranges of angles of the cam disc can be defined. Thus herein, the defined positions of angles of rotation and ranges of angles of rotation correspond to angle positions and ranges of angles on the cam disc.

Thus preferably, it is intended that the cam disc be heart-shaped and thereby includes a pointed area, wherein, at a position of angle of rotation of 0°, the pointed area is directed to the second contact surface. In particular in this case, a first delimiting range of angles of rotation is located between −10° and +10°, preferably between −5° and +5°. Said values indicate upper thresholds for the described delimiting range of angles of rotation, which may be smaller as well. Essentially, the first delimiting range of angles of rotation extends over the pointed area of the cam disc. With a corresponding configuration of the distancing arrangement it is ensured that in the first delimiting range of angles of rotation the second contact surface is spaced apart from the cam disc and accordingly herein the surface load is reduced. This is in particular advantageous, if the door actuator is formed for a pivoting movement of the door leaf. With the pivoting movement of the door leaf, the door leaf can swing, respectively move back and forth, beyond the closed position thereof. Thereby, in a pivoting movement, the cam disc passes through the position of 0°, whereby, without the inventive distancing arrangement, each time there would be a very stressful contact with the second contact surface.

Furthermore, it is preferably intended the cam disc be heart-shaped and in this case includes the depressed area, wherein the centre of the depressed area is directed onto the second contact surface at a position of angle of rotation of V. In this case, V is located between 120° and 240°. Preferably, the distancing arrangement is formed for a second delimiting range of angles of rotation, which is located between V −45° and V +45°, preferably between V −30° and V +30°. Herein again are indicated upper thresholds for the second delimiting range of angles of rotation, wherein the second delimiting range of angles of rotation can be smaller as well. On account of the second delimiting range of angles of rotation, a contact of the second contact surface with the depressed area of the heart-shaped cam disc is prevented such that the second contact surface does not "fall" into said depressed area.

According to a first variant of the distancing arrangement, it is intended the distancing arrangement comprise at least one distancing element, wherein the distancing element is linearly guided in one of the two elements of motion. In this case, the distancing element is formed such that, in the delimiting range of angles of rotation, it abuts against said element of motion, in which it is linearly guided.

Theoretically, the distancing element can be linearly movably guided at both elements of motion and then correspondingly abut against both elements of motion in the delimiting range of angles of rotation. However, in a preferred embodiment, it is intended that the distancing element be linearly movably guided at only one element of motion and be firmly linked at the other element of motion. However, instead of said firm link at the other element of motion, it is also possible to form the distancing element integrally with said element of motion such that the distancing element forms an integral component of said element of motion.

In particular, at least two of the distancing elements are provided. Then said two distancing elements serve simultaneously as the anti-rotation protection for the two elements of motion with regard to each other. However, such an anti-rotation protection can be achieved with only one distancing element; for example if the distancing element does not have a round cross-section in the linearly guided area thereof.

Preferably, the at least one element of motion, in which the distancing element is linearly movably guided, includes a recess. The distancing element is fitted in said recess and is correspondingly linearly movably guided in the recess.

Furthermore preferably, it is intended the distancing element include a shoulder. Said shoulder serves as the abutment and abuts against the element of motion, in order to delimit the minimum distance.

In particular, the at least one distancing element is formed as a rod. The rod can be firmly linked in one of the two elements of motion, for example via a thread or a press-fit. On the other side, the rod is linearly movably inserted into a hole of the element of motion.

When employing at least two of the distancing elements, preferably, it is intended the two distancing elements be disposed on two different sides of the output shaft. Thus, the imaginary output axis, about which the output shaft rotates, extends between the two distancing elements.

According to a second variant of the distancing arrangement, it is intended the distancing arrangement comprise a distancing cam disc on the output shaft and a distancing element. The distancing cam disc has a different contour than the previously described cam disc. The distancing cam disc can directly adjoin the cam disc or be spaced apart from the cam disc. In said second variant, the distancing element is located at the second element of motion. The distancing element is firmly connected to the second element of motion or is integrally configured with the second element of motion. The distancing element according to said second variant does not extend as far as to the other element of motion, but just as far as to the distancing cam disc. In the delimiting range of angles of rotation, the distancing cam disc is resting against the distancing element. The contour of the distancing cam disc is formed such that, in the free range of angles of rotation, it does not have any contact with the distancing element, but only reaches contact with the distancing element in the at least one delimiting range of angles of rotation. In this case, the distancing element and the distancing cam disc are disposed and formed such that, in the delimiting range of angles of rotation, the cam disc and the second contact surface are spaced apart from each other.

In particular, in the second variant of the distancing arrangement, it is intended the door actuator comprise an additional anti-rotation protection between the two elements of motion. For example, said anti-rotation protection can be formed by means of at least two rods. In this case, the rods are linearly movably guided in at least one element of motion and do not have any abutments such that the rods just guarantee an anti-rotation protection, however, not a distance limitation between the two elements of motion. The rods of the anti-rotation protection can extend in a restriction of the output shaft between the cam disc and the distancing cam disc.

Furthermore preferably, it is intended the radius at the pointed area of the distancing cam disc be greater than the radius at the pointed area of the cam disc. Said relatively large radius at the pointed area of the distancing cam disc prevents a too important a surface load between the distancing cam disc and the associated distancing element. In particular, the radius at the pointed area of the distancing cam disc is at least 20% greater than the radius at the pointed area of the cam disc.

BRIEF DESCRIPTION OF THE DRAWINGS

The disclosure will now be described in more detail, based on two exemplary embodiments. In the figures.

DETAILED DESCRIPTION OF THE DRAWINGS

Figure 1:
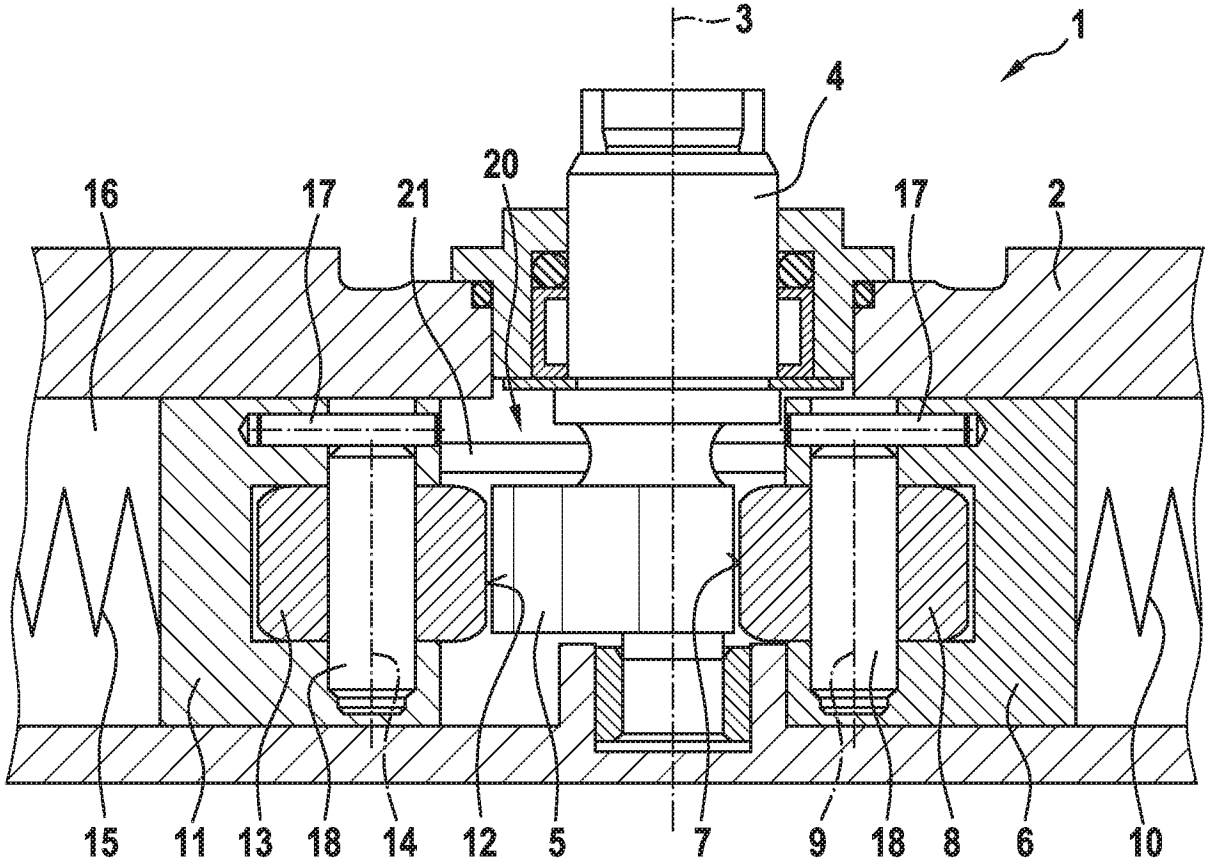
FIG. 1 is a diagrammatical view of an inventive door actuator according to a first exemplary embodiment.

Based on FIGS. 1 to 11, two exemplary embodiments of a door actuator 1 will be explained. The identical, respectively functionally identical structural components are identified by the same reference numerals in both exemplary embodiments.

FIG. 1 shows a diagrammatical illustration of the entire door actuator 1 for the first exemplary embodiment. For the second exemplary embodiment, the door actuator 1 is configured in the same way, just with the modifications, which will be described based on the FIGS. 8 to 11 with the second exemplary embodiment.

FIG. 1 shows a diagrammatical sectional view of the door actuator 1 with the housing 2 thereof. An output shaft 4 is rotationally movably supported in the housing 2. The output shaft 4 is rotationally movable about an output axis 3.

A cam disc 5 is located on the output shaft 4. The cam disc 5 and the output shaft 4 are located between a first element of motion 6 and a second element of motion 11. Herein, the first element of motion 6 is formed as an opening piston. Herein, the second element of motion 11 is formed as a dampening piston. The entire door actuator 1 is formed as a door closer.

The two elements of motion 6, 11 are linearly movably guided vertically with regard to the output axis 3 in the housing 2.

The first element of motion 6 includes a first roller 8. The circumferential surface of the first roller 8 forms a first contact surface 7. In the first element of motion 6, the first roller 8 is rotationally movably supported about a first roller axis 9. The first roller axis 9 extends parallel to the output axis 3.

The second element of motion 11 includes a second roller 13. The circumferential surface of the second roller 13 forms a second contact surface 12. The second roller 13 is rotationally movably supported about a second roller axis 14 in the second element of motion 11. The second roller axis 14 extends parallel to the output axis 3.

Furthermore, the door actuator 1 includes a first spring 10. Herein, the first spring 10 serves as the closing spring. The first spring 10 is disposed in the housing 2 on a side of the first element of motion 6 facing away from the cam disc 5. On the one side, the first spring 10 props up against the first element of motion 6, on the other side, the first spring 10 can prop up against the housing 2 or against a non-illustrated spring adjustment. Upon opening the door, said first spring 10 is tensioned. By relaxing the first spring 10, then according to the illustration in FIG. 1, the first element of motion 6 can move to the left hand side, wherefrom results a rotary movement of the cam disc 5 and thus of the output shaft 4. Furthermore, the door actuator 1 comprises a second spring 15 in the housing 2. The second spring 15 is located on the side of the second element of motion 11 facing away from the cam disc 5. One side of the second spring 15 props up against the second element of motion 11. In the illustration according to FIG. 1, the arrangement of the two springs 10, 15 is purely diagrammatically shown.

Furthermore, FIG. 1 shows purely diagrammatically a hydraulic chamber 16 within the housing 2. During the linear movement thereof, the second element of motion 11 can drive fluid out of the hydraulic chamber 16, wherefrom results a dampening of the movement of the second element of motion 11.

Furthermore, FIG. 1 shows that the two rollers 8, 13 have roller shafts 18. Said roller shafts 18 extend along the first, respectively the second roller axis 9, 14. When mounting, said roller shafts 18 are inserted into the respective element of motion 6, 11, and secured with bolts 17 against falling out. Then said bolts 17 extend correspondingly vertically to the roller axes 9, 14.

Furthermore, FIG. 1 shows a distancing arrangement 20 at, respectively between the two elements of motion 6, 11.

FIGS. 2 to 7 show the detailed configuration of the distancing arrangement 20 according to the first exemplary embodiment.

Figure 2:
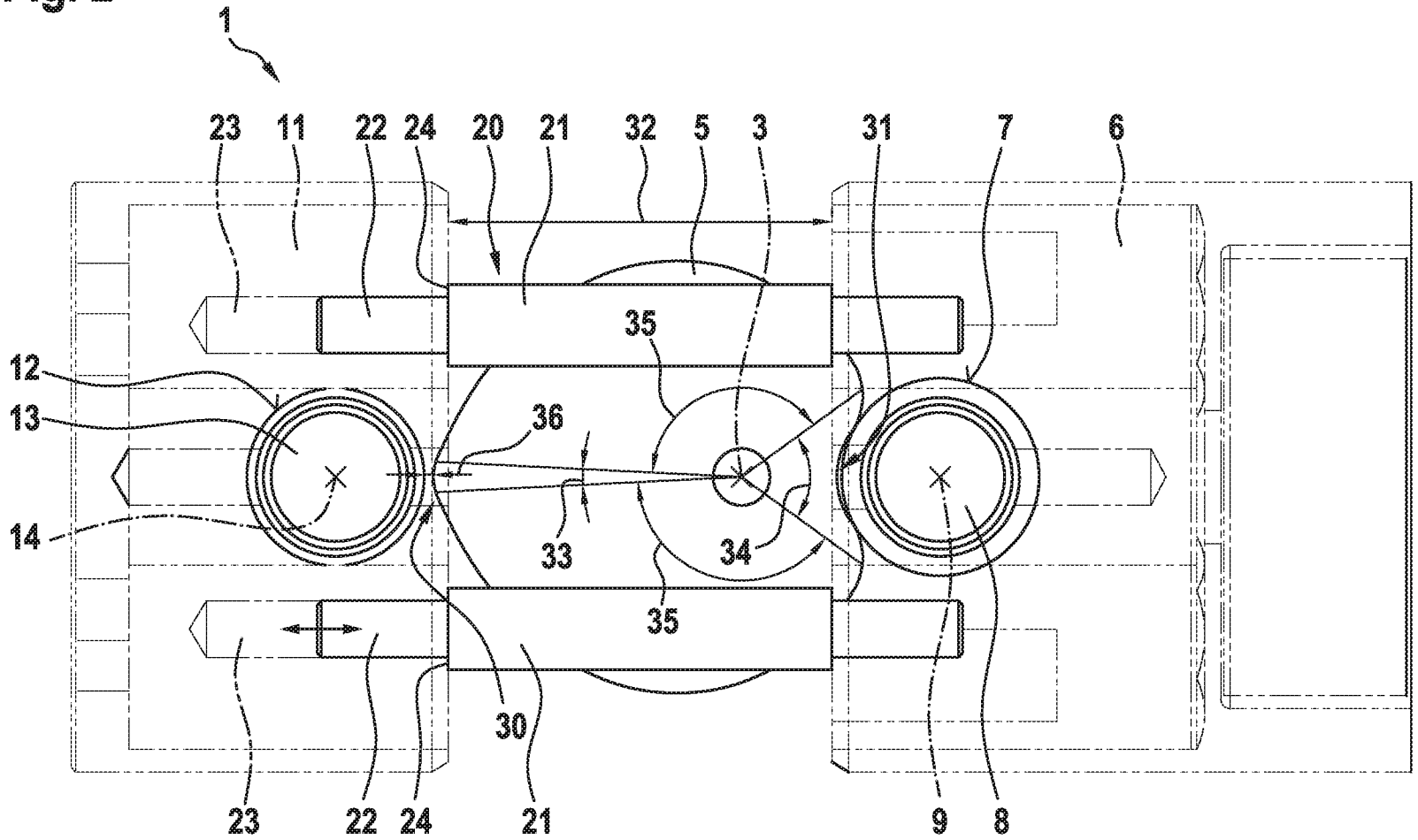
FIGS. 2 to 7 are detailed illustrations of the inventive door actuator according to the first exemplary embodiment.

According to FIG. 2, the distancing arrangement 20 comprises two distancing elements 21, herein formed as rods.

Each distancing element 21 includes an extension 22. Said extension 22 is linearly movably inserted into a recess 23 in the second element of motion 11. On the opposite side, the distancing elements 21 are firmly connected to the first element of motion 6.

On account of the linear mobility between the extension 22 and the recess 23, basically, the two elements of motion 6, 11 are movable in relation to each other vertically to the output axis 3.

Figure 5:
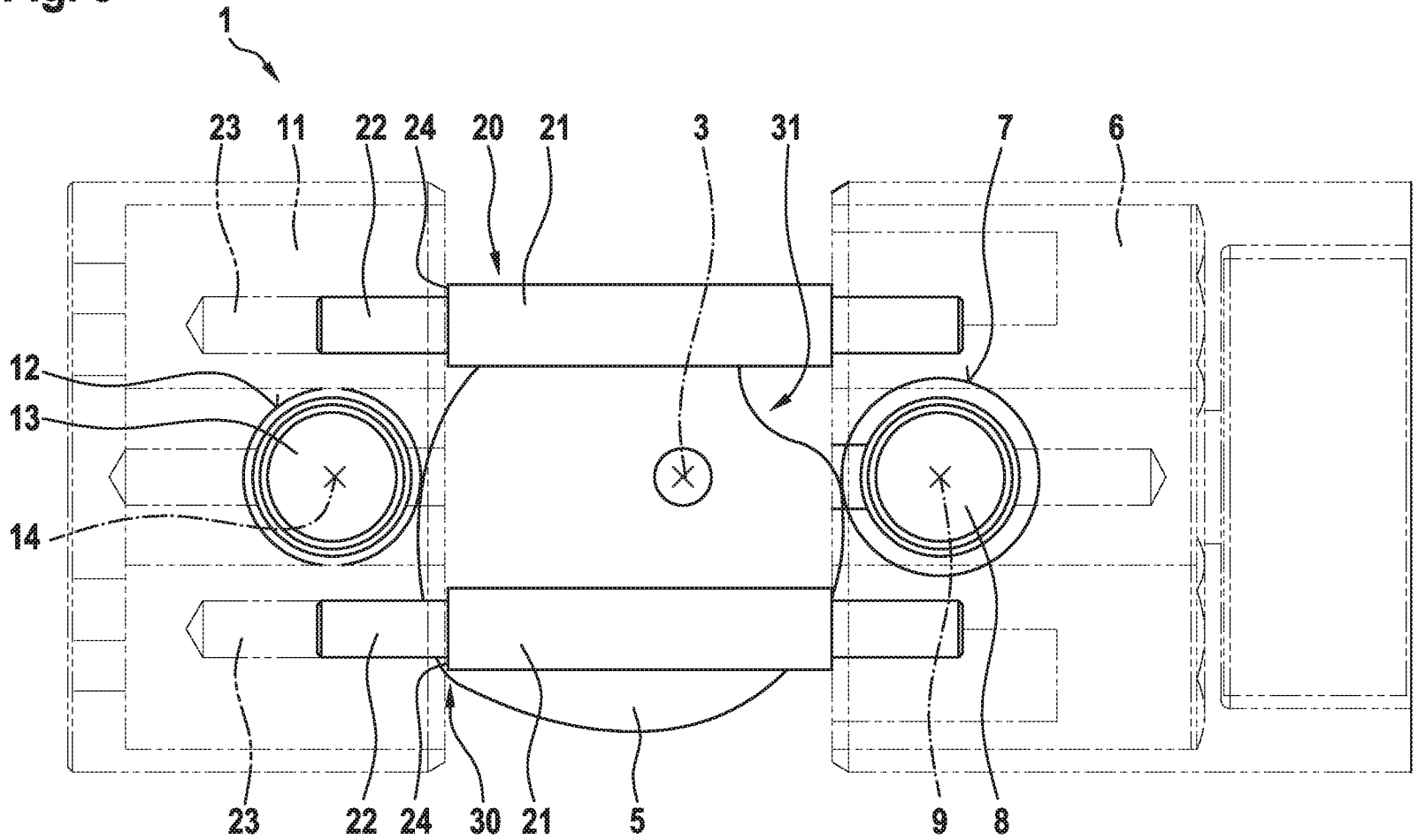

However, in order to delimit a distance 32 between the two elements of motion 6, 11, in certain positions of angles of rotation of the output shaft 4, respectively of the cam disc 5, the individual distancing element 21 includes a shoulder 24. At the desired minimum distance, said shoulder 24 can abut against the second element of motion 11. In particular the illustration in FIG. 5 shows that, at the corresponding position of angle of rotation, an interspace can result between the shoulder 24 of the distancing element 21 and the second element of motion 11.

FIG. 2 shows the cam disc 5 in a vertical plane with regard to the output axis 3. In this case, it can be very well seen that the cam disc 5 is heart-shaped formed. Said heart shape has a pointed area 30 and an opposite depressed area 31. In the position illustrated according to FIG. 2, the pointed area 30 is directed towards the second contact surface 12. In particular in said position, the door leaf is in the closed position thereof. Accordingly, said position of angle of rotation of the door leaf and of the output shaft 4 and of the cam disc 5 is described with 0°.

Said position of angle of rotation of 0° defines a first delimiting range of angles of rotation 33. In particular, said first delimiting range of angles of rotation 33 extends over the pointed area 30 of the cam disc 5. Approximately opposite thereof is defined a second delimiting range of angles of rotation 34. The second delimiting range of angles of rotation 34 extends approximately over the depressed area 31 of the cam disc 5. The precise ranges of angles for the two delimiting ranges of angles of rotation 33, 34 have been defined in the general part. Two free ranges of angles of rotation 35 are located between the two delimiting ranges of angles of rotation 33, 34.

In the illustration according to FIG. 2, the door actuator is in the position of angle of rotation of 0° and thus within the first delimiting range of angles of rotation 33. Herein, the distancing arrangement 22 is formed such that the shoulder 24 rests against the second element of motion 11 and thus the distance 32 is delimited. Therefrom results an interspace 36 between the second contact surface 12 and the cam disc 5, whereby a too large a surface load in the pointed area 30 is prevented. FIGS. 3, 4, 6 and 7 in a magnifying type show the area between the second roller 13 and the cam disc 5 in an enlarged illustration.

Figure 3:
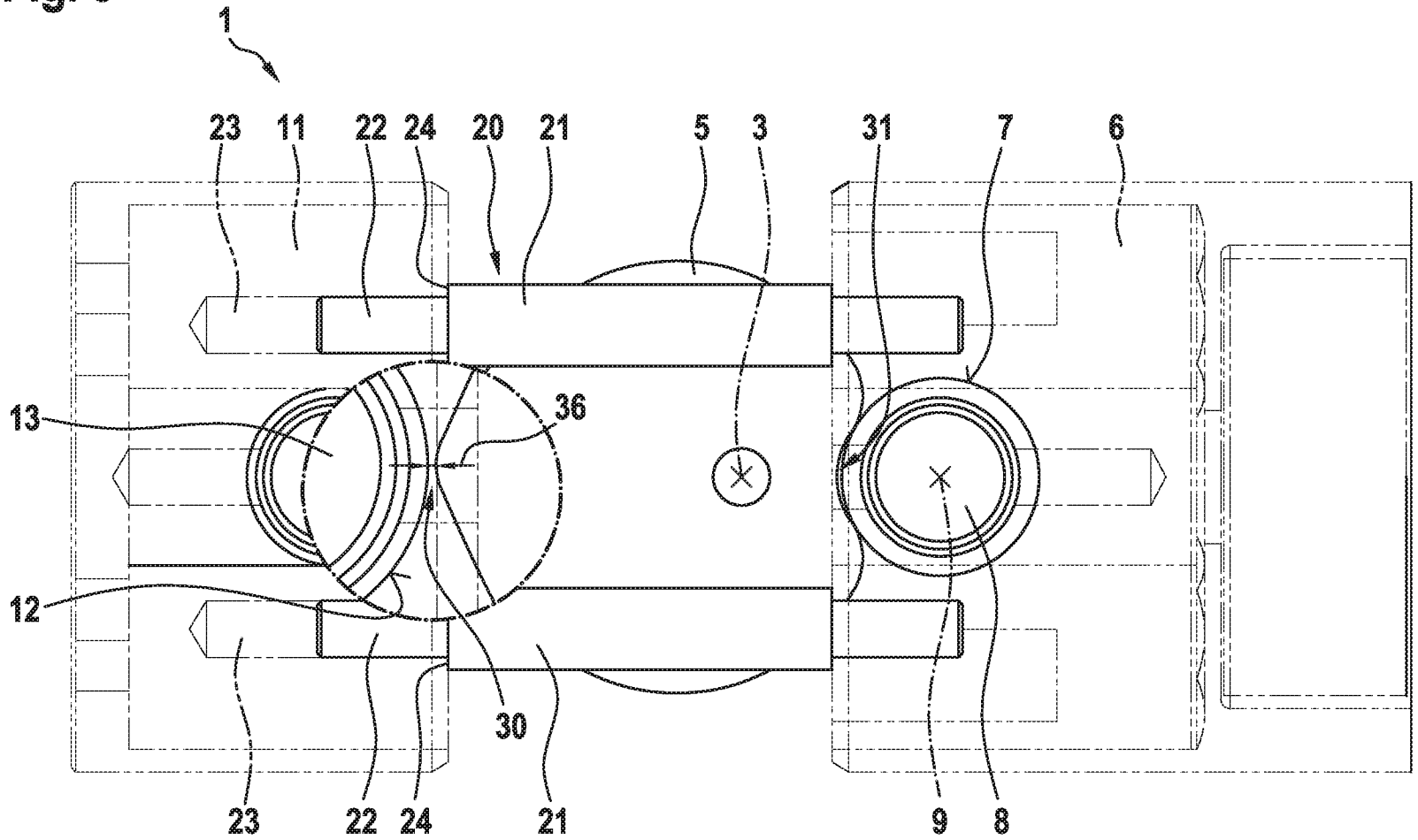

FIG. 3, just like FIG. 2, shows the position of angle of rotation of 0°. In said enlarged illustration can be seen the interspace 36 between the second contact surface 12 and the pointed area 30 of the cam disc 5.

Figure 4:
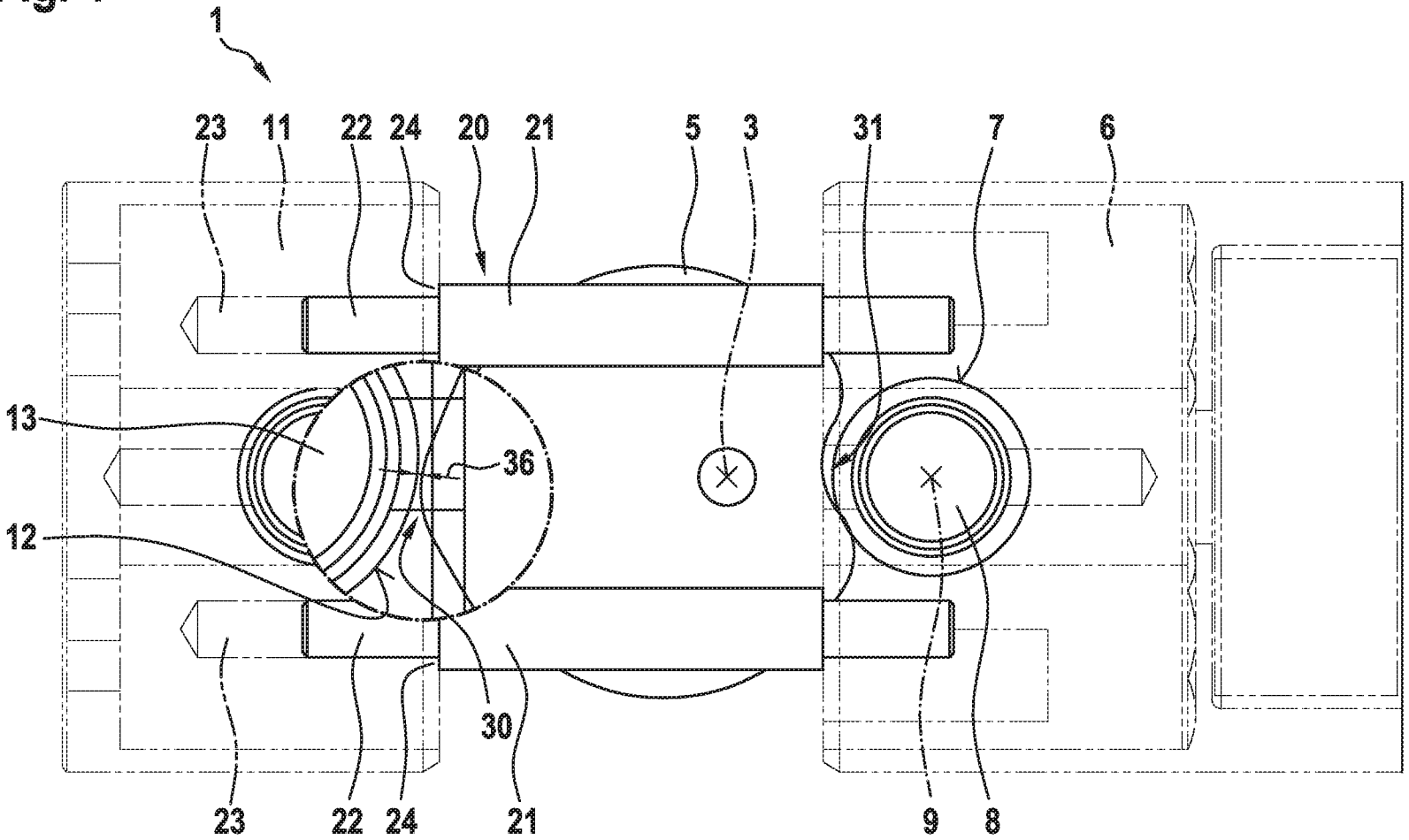

FIG. 4 shows the transition from the first delimiting range of angles of rotation 33 to the neighbouring free range of angles of rotation 35. During said movement, the interspace 36 continuously decreases until the second contact surface 12 reaches contact with the cam disc 5.

FIG. 5 shows the door actuator 1 in the free range of angles of rotation 25, in which the contact between the second contact surface 12 and the cam disc 5 is established. In contrast to the delimiting range of angles of rotation 33, 34, herein the distance 32 increased between the two elements of motion 6, 11. Accordingly, also the shoulder 24 does not rest anymore against the second element of motion 11. Both rollers 8, 13 and thus both contact surfaces 7, 12 roll on the cam disc 5.

Figure 6:
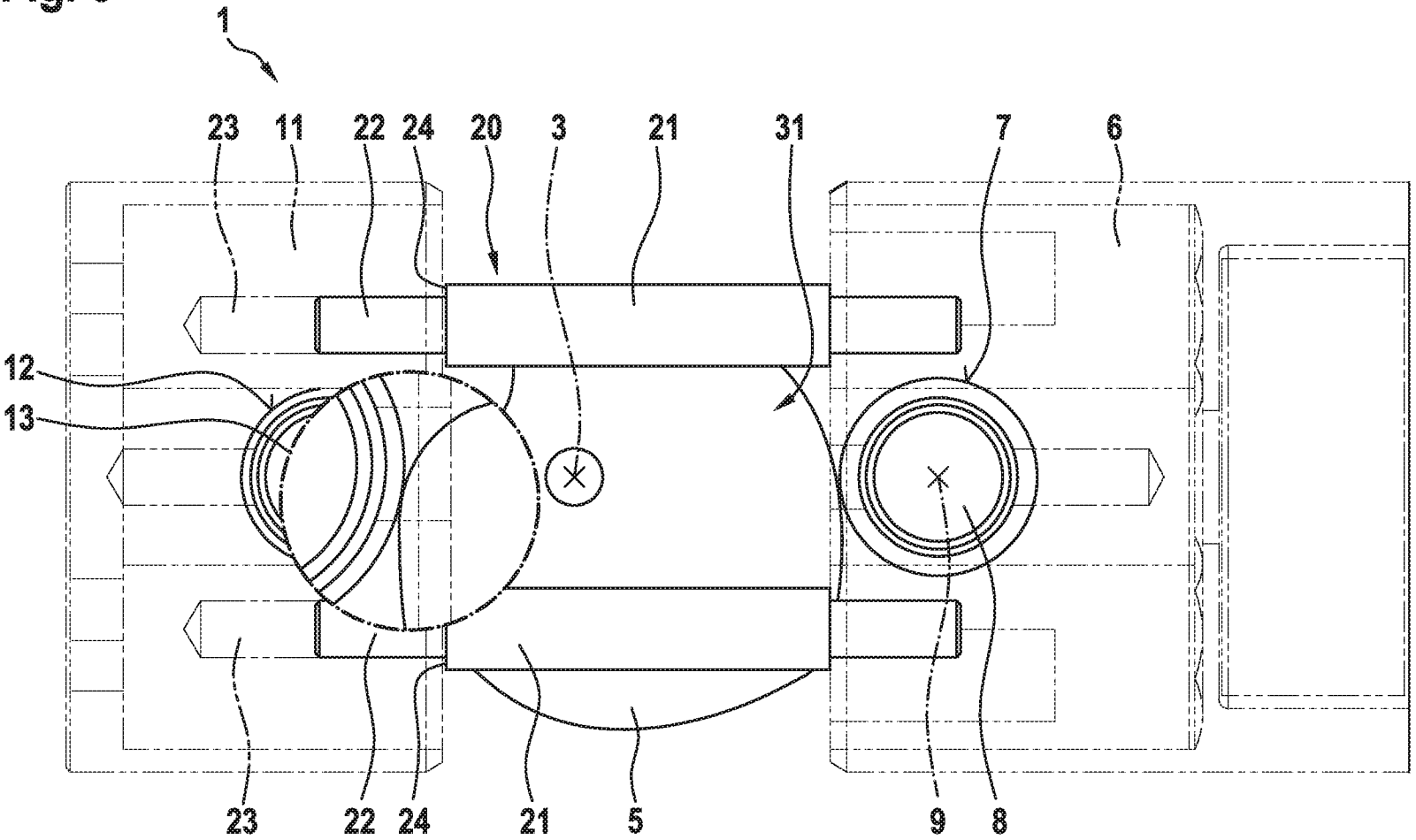

FIG. 6 shows the transition from the free range of angles of rotation 35 into the second delimiting range of angles of rotation 34. In the illustration according to FIG. 6, the second contact surface 12 is still in contact with the cam disc 5.

Figure 7:
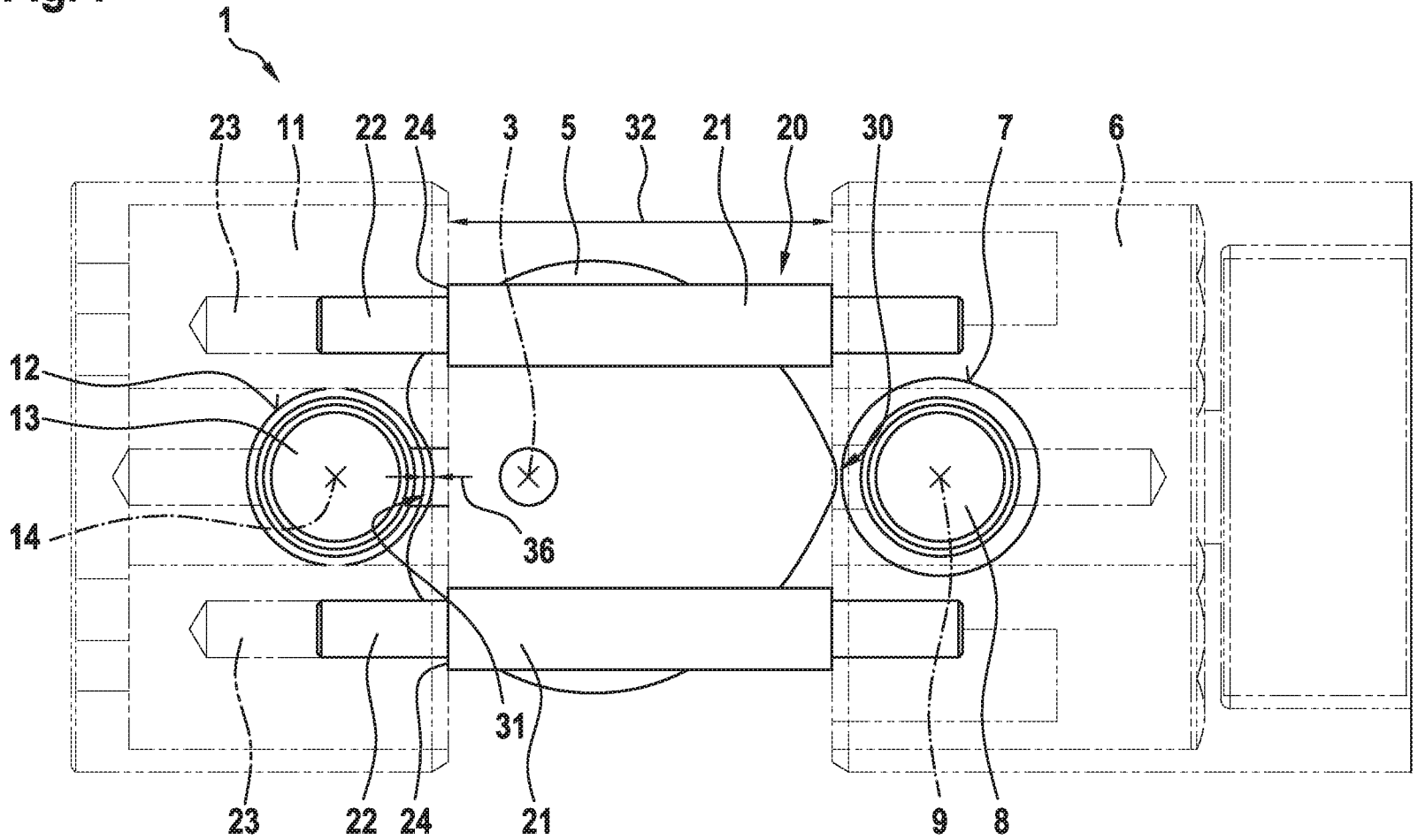

FIG. 7 illustrates the second delimiting range of angles of rotation 34. Herein, the distancing arrangement 20 delimits the distance 32 again to a minimum distance such that the interspace 36 is adjusted between the second contact surface 12 and the cam disc 5. Based on the FIG. 7, it can be seen that, in the second delimiting range of angles of rotation 34, the second roller 13 does not rest in the depressed area 31 of the heart-shaped cam disc 5.

The second exemplary embodiment of the door actuator 1 is described based on the FIGS. 8 to 11. The basic structure of the door actuator 1 is already described based on FIG. 1. The two exemplary embodiments just differ in the configuration of the distancing arrangement 20.

Figure 8:
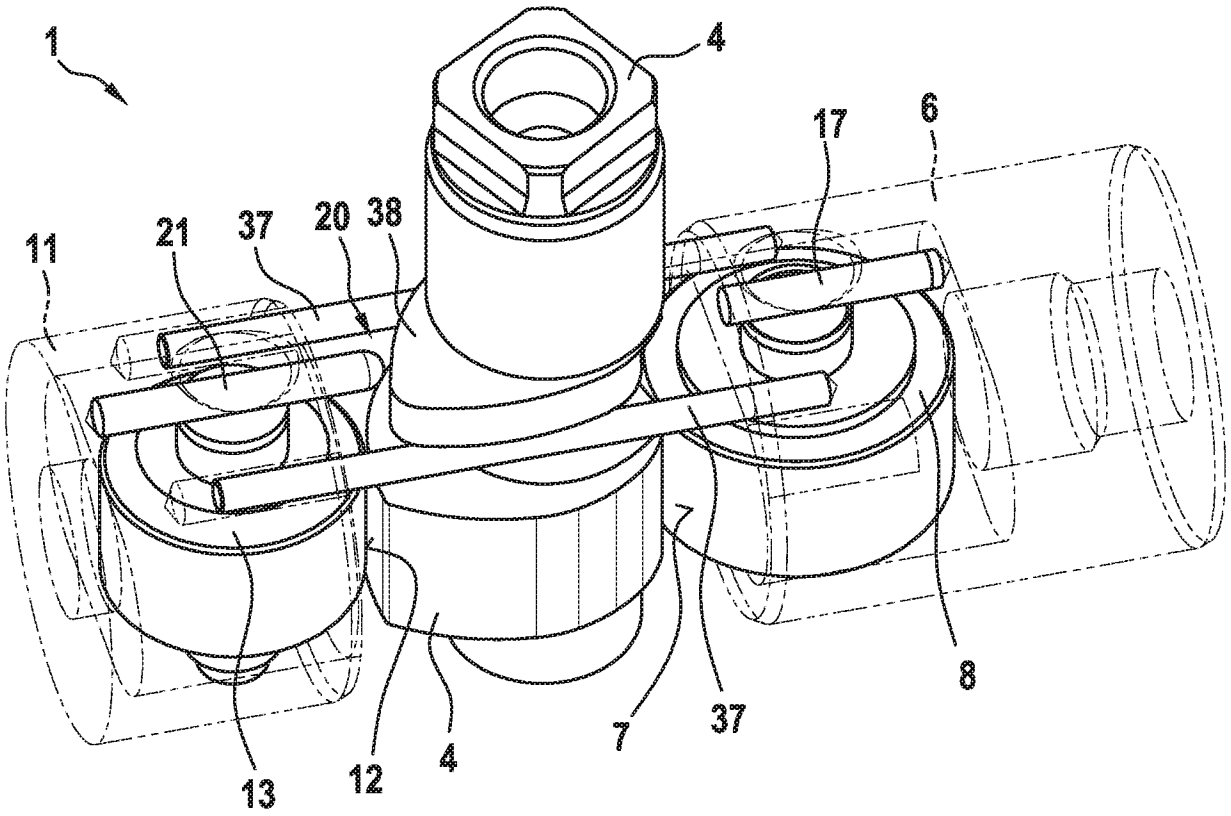
FIGS. 8 to 11 are detailed illustrations of the inventive door actuator according to a second exemplary embodiment.

FIG. 8 shows a perspective view of two anti-rotation protections 37, which are formed as rods. Said two anti-rotation protections 37 are inserted in the two elements of motion 6, 11 and they are linearly movably guided in said two elements of motion 6, 11. However, the anti-rotation protections 37 do not include an abutment, which would prevent a contact between one of the contact surfaces 7, 12 and the cam disc 5. The two anti-rotation protections 37 just serve for the purpose the two elements of motion 6, 11 will not rotate about an axis, which is vertical with regard to the output axis 3.

The distancing arrangement 20 of the second exemplary embodiment comprises a distancing element 21, which, herein however, is just inserted into the second element of motion 11. Herein, the distancing element 21 is firmly connected to the second element of motion 11. As an alternative, the distancing element 21 could also be an integral component of the second element of motion 11.

Furthermore herein, the distancing arrangement 20 comprises a distancing cam disc 38 on the output shaft 4. In the exemplary embodiment shown, the distancing cam disc 38 is spaced apart from the cam disc 5. The two anti-rotation protections 37 extend between the distancing cam disc 38 and the cam disc 5.

Herein, the distancing element 21 and the distancing cam disc 38 are formed and disposed such that they contact each other in the first and second delimiting ranges of angles of rotation 33, 34 and thereby delimit the distance 32. There is no contact between the distancing element 21 and the distancing cam disc 38 in the two free ranges of angles of rotation 35.

In the second exemplary embodiment, the distancing element 21 simultaneously fulfills the function of the bolt 17, because the distancing element 21 is disposed such that it secures the roller shaft 18 of the second roller 13 against falling out.

Figure 9:
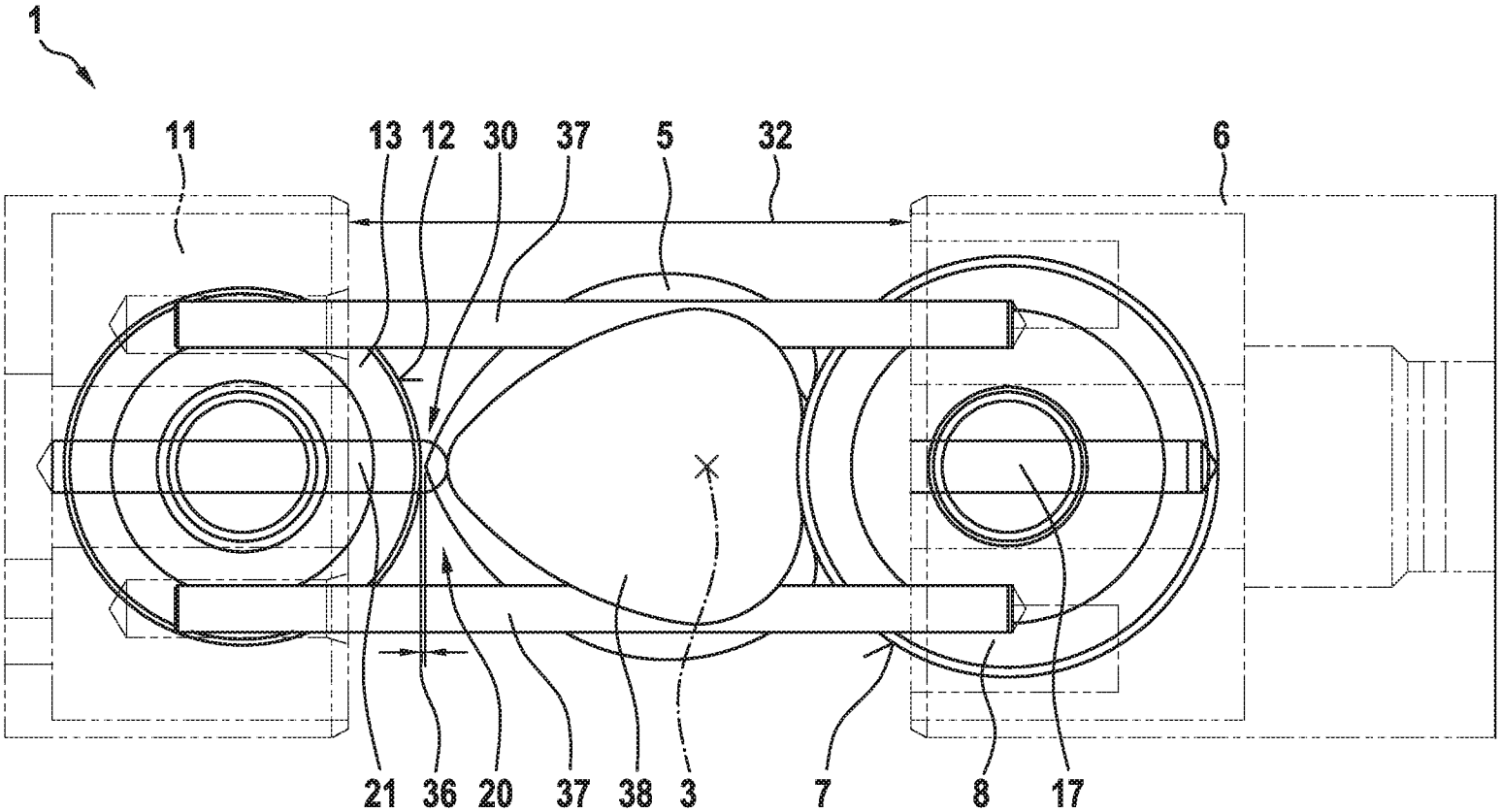
Figure 10:
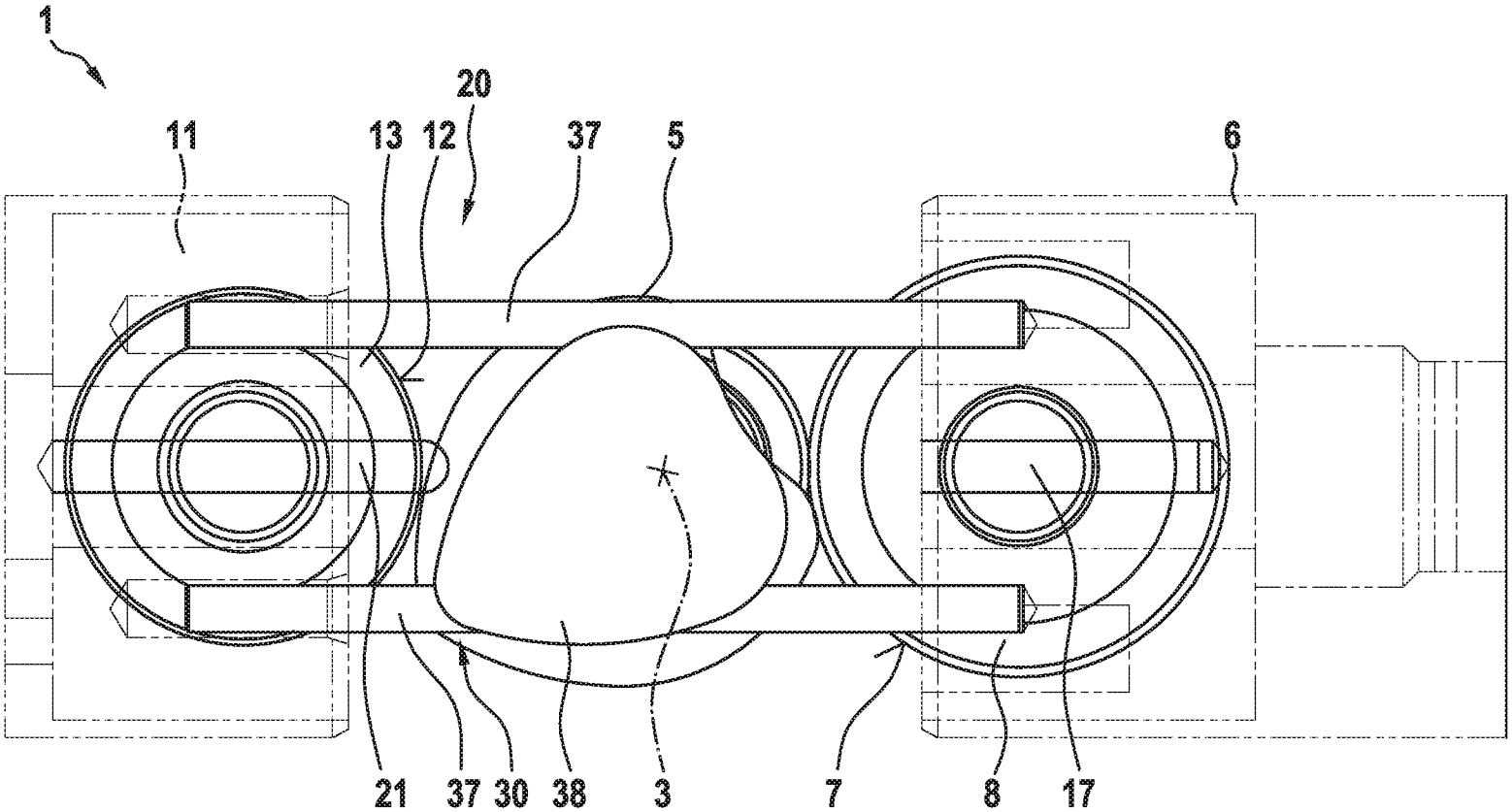
Figure 11:
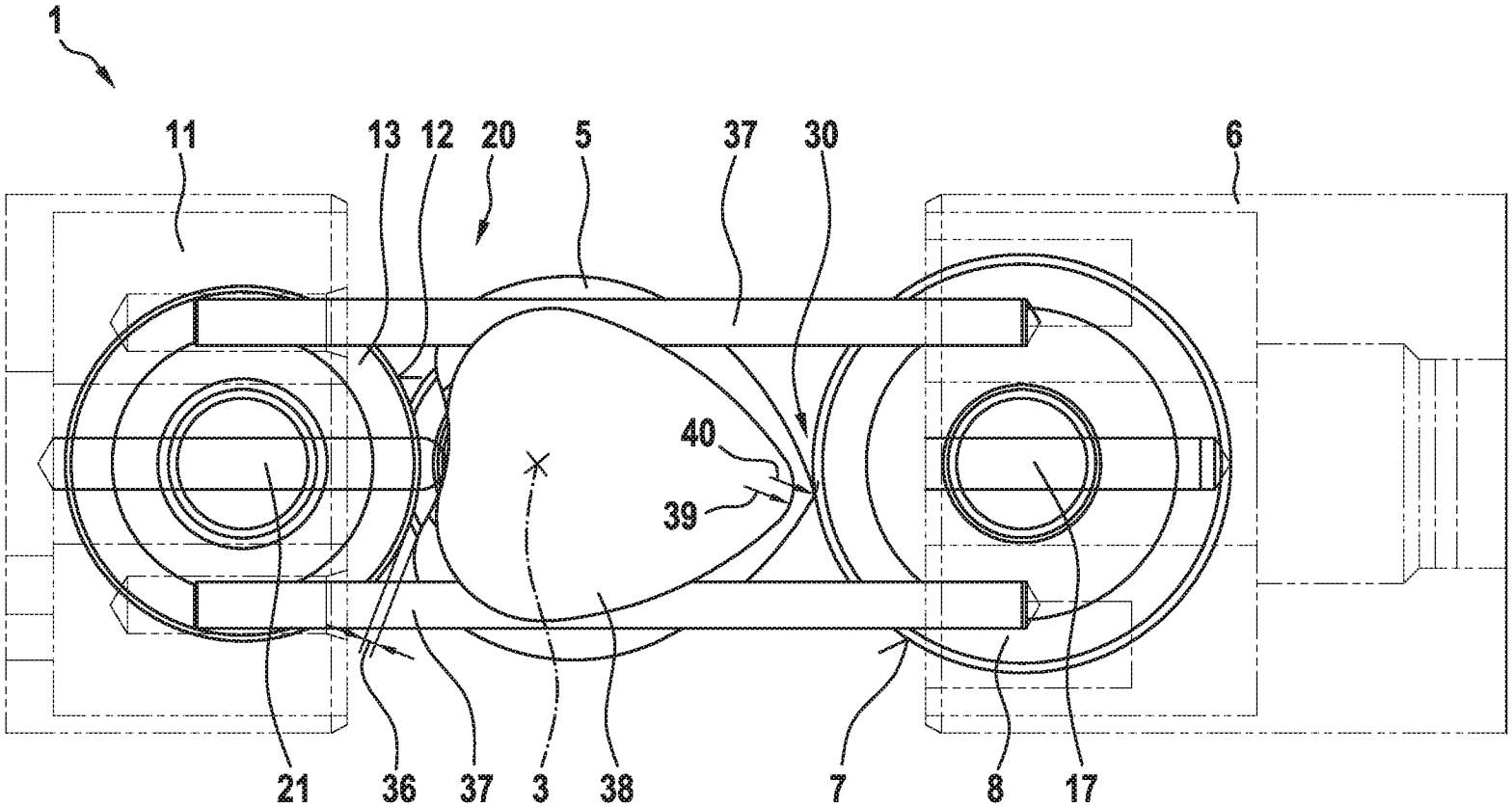

FIGS. 9 to 11 show illustrations for the second exemplary embodiment in a plane vertical to the output axis 3.

FIG. 9 shows the first delimiting range of angles of rotation 33. Herein, the distancing cam disc 38 and the distancing element 21 are in contact and thereby delimit the distance 32 such that there is an interspace 36 between the second contact surface 12 and the cam disc 5.

FIG. 10 shows one of the two free ranges of angles of rotation 35. Herein, both contact surfaces 7, 12 are in contact with the cam disc 5. The distancing cam disc 38 and the distancing element 21 do not contact each other.

FIG. 11 shows the second delimiting range of angles of rotation 34, in which again the interspace 36 is adjusted by a contact between the distancing element 21 and the distancing cam disc 38.

As further clarified in FIGS. 8 to 11, also the distancing cam disc 38 is formed heart-shaped and correspondingly includes a pointed area and an opposite depressed area.

Preferably, a radius 39 at the pointed area of the distancing cam disc 38 is configured to be larger than a radius 40 at the pointed area of 30 of the cam disc 5.

The invention claimed is:

1. A door actuator for opening and/or closing a door leaf, the door actuator comprising:

a housing, an output shaft rotatably supported in the housing and with a cam disc, wherein the output shaft is formed for transferring torque onto the door leaf, a first element of motion, which is linearly movably guided in the housing and has a first contact surface, a second element of motion, which is linearly movably guided in the housing and has a second contact surface, and a distancing arrangement disposed in the housing, wherein the cam disc is disposed between the two contact surfaces and disposed for rolling on the two contact surfaces, wherein, in at least one delimiting range of angles of rotation of the output shaft, the distancing arrangement delimits a minimum distance between the elements of motion and in at least one free range of angles of rotation, does not delimit the linear mobility of the two elements of motion in relation to each other, and wherein, in the at least one delimiting range of angles of rotation, only one of the two contact surfaces rests against the cam disc and the other contact surface is spaced apart from the cam disc.

2. The door actuator according to claim 1, wherein in each free range of angles of rotation, the two contact surfaces rest against the cam disc.

3. The door actuator according to claim 1, wherein the cam disc is heart-shaped and includes a pointed area, wherein, at a position of angle of rotation of 0°, the pointed area is directed towards the second contact surface and a first delimiting range of angles of rotation is between −10° and +10°.

4. The door actuator according to claim 3, wherein the cam disc is heart-shaped and includes a depressed area, wherein, at a position of angle of rotation of V, a centre of the depressed area is directed towards the second contact surface, wherein V is between 120° and 140°, and wherein a second delimiting range of angles of rotation is between V −45° and V +45°.

5. The door actuator according to claim 1, wherein the distancing arrangement comprises a distancing element, wherein the distancing element is linearly movably guided in one of the two elements of motion, and in the delimiting range of angles of rotation abuts against said one of the two elements of motion.

6. The door actuator according to claim 5, wherein the distancing element linearly movably slides in a recess in one of the two elements of motion.

7. The door actuator according to claim 5, wherein the distancing element includes a shoulder as an abutment.

8. The door actuator according to claim 5, wherein the distancing element is firmly connected to one of the two elements of motion or is formed integrally with one of the two elements of motion.

9. The door actuator according to claim 1, wherein the distancing arrangement includes a distancing cam disc on the output shaft and a distancing element at the second element of motion, wherein the distancing element is firmly connected to the second element of motion or integrally formed with the second element of motion, wherein in the at least one delimiting range of angles of rotation the distancing cam disc rests against the distancing element.

10. The door actuator according to claim 9, wherein the radius at a pointed area of the distancing cam disc is greater than the radius at a pointed area of the cam disc.

11. The door actuator according to claim 1, comprising a first spring in the housing, wherein the first element of motion is movable using the first spring in the direction of the cam disc.

12. The door actuator according to claim 11, comprising a second spring in the housing, wherein the second element of motion is movable using the second spring in the direction of the cam disc.

13. The door actuator according to claim 1, comprising a hydraulic chamber in the housing, wherein, by moving the second element of motion, fluid is configured to be driven out of the hydraulic chamber through a throttle.

14. The door actuator according to claim 1, wherein the first contact surface is formed by a first roller rotatably supported in the first element of motion, or wherein the second contact surface is formed by a second roller rotatably supported in the second element of motion.

* * * * *